US009187907B2

(12) United States Patent
Schraga

(10) Patent No.: US 9,187,907 B2
(45) Date of Patent: Nov. 17, 2015

(54) DRYWALL JOINT SYSTEM AND METHOD

(76) Inventor: Steven Schraga, Surfside, FL (US)

( * ) Notice: Subject to any disclaimer, the term of this patent is extended or adjusted under 35 U.S.C. 154(b) by 0 days.

(21) Appl. No.: 11/758,994

(22) Filed: Jun. 6, 2007

(65) Prior Publication Data

US 2008/0302047 A1 Dec. 11, 2008

(51) Int. Cl.
*E04F 13/04* (2006.01)
*E04B 2/72* (2006.01)

(52) U.S. Cl.
CPC ..... *E04F 13/042* (2013.01); *E04B 2/723* (2013.01); *E04F 13/04* (2013.01)

(58) Field of Classification Search
CPC ..... E04F 13/04; E04F 13/042; E04B 2/723
USPC ..... 52/415–417, 459–462, 465–472, 404.4, 52/533, 433, 450, 588.1; 156/304.3, 304.5
See application file for complete search history.

(56) References Cited

U.S. PATENT DOCUMENTS

| | | | | | |
|---|---|---|---|---|---|
| 835,889 | A | * | 11/1906 | Moeller | 52/521 |
| 1,383,249 | A | | 6/1921 | Utzman | |
| 1,634,808 | A | * | 7/1927 | Weiss | 52/417 |
| 1,634,809 | A | * | 7/1927 | Weiss | 428/101 |
| 1,642,282 | A | * | 9/1927 | Weiss | 52/417 |
| 2,047,982 | A | * | 7/1936 | Page | 52/417 |
| 2,054,246 | A | * | 9/1936 | Dalzell | 52/578 |
| 2,200,750 | A | | 5/1940 | Kenney | |
| 2,814,080 | A | * | 11/1957 | Tvorik et al. | 52/417 |
| 3,385,019 | A | * | 5/1968 | Frank | 52/417 |
| 3,609,934 | A | * | 10/1971 | O'Carrol | 52/461 |
| 3,657,850 | A | | 4/1972 | Billarant | |
| 3,708,935 | A | * | 1/1973 | Kossuth et al. | 52/416 |
| 3,893,272 | A | * | 7/1975 | Plom | 52/235 |
| 3,998,015 | A | | 12/1976 | Scoot et al. | |
| 4,104,840 | A | * | 8/1978 | Heintz et al. | 52/309.9 |
| 4,187,653 | A | * | 2/1980 | Kliewer, Jr. | 52/98 |
| 4,553,363 | A | | 11/1985 | Weinar | |
| 4,586,308 | A | * | 5/1986 | Jennings | 52/393 |
| 4,680,909 | A | * | 7/1987 | Stewart | 52/409 |
| 4,706,435 | A | * | 11/1987 | Stewart | 52/533 |
| 4,869,037 | A | | 9/1989 | Murphy | |
| 5,311,717 | A | * | 5/1994 | Yount et al. | 52/417 |
| 5,487,250 | A | * | 1/1996 | Yount et al. | 52/417 |
| 5,891,282 | A | * | 4/1999 | Stough et al. | 156/71 |
| 6,006,481 | A | * | 12/1999 | Jacobs | 52/309.9 |
| 6,857,243 | B2 | * | 2/2005 | Bloomfield | 52/591.4 |
| 7,178,306 | B2 | * | 2/2007 | Fritz | 52/746.11 |
| 7,380,381 | B2 | * | 6/2008 | Honda | 52/461 |
| 8,257,526 | B2 | * | 9/2012 | Thompson et al. | 156/71 |
| 8,959,861 | B1 | * | 2/2015 | Wambaugh et al. | 52/409 |
| 2005/0246993 | A1 | * | 11/2005 | Colbert et al. | 52/459 |
| 2006/0070331 | A1 | * | 4/2006 | Yakobics | 52/581 |
| 2008/0302047 | A1 | * | 12/2008 | Schraga | 52/460 |

* cited by examiner

*Primary Examiner* — Andrew J Triggs
(74) *Attorney, Agent, or Firm* — Greenblum & Bernstein, P.L.C.

(57) ABSTRACT

Drywall joint formed by a sheet having a first side, a back side, and oppositely arranged beveled edges. A flap is arranged in an area of one of the beveled edges and has a free end which extends out beyond an end of the one of the beveled edges. At least one of the flap being an integral part of a facing forming the first side of the sheet and the flap being a separately formed member that is secured to a facing forming the first side of the sheet. The method provides for arranging the first beveled edge of one sheet adjacent to the second beveled edge of another sheet, securing the adjacent first and second beveled edges to a stud with fasteners, and applying a joint compound over at least a portion of the flap. This Abstract is not intended to define the invention disclosed in the specification, nor intended to limit the scope of the invention in any way.

27 Claims, 23 Drawing Sheets

DRYWALL JOINT SYSTEM AND METHOD

BACKGROUND OF THE INVENTION

1. Field of the Invention

This invention relates generally to a drywall joint system and method. The invention can be applied to any type of drywall whether conventional or otherwise. More specifically, the invention relates to a drywall sheet or panel which utilizes an attached or integrally formed joint tape. The invention also relates to a method of forming a drywall joint which does not require the use of conventional joint tape.

2. Discussion of Background Information

Drywall, also known as sheetrock or gypsum wall board, is typically available in sheets measuring 4×8 feet or 4×12 feet. Each sheet has a front side which is configured to receive, e.g., paint, wallpaper, and/or other covering layers, and a back side which is configured to contact wall studs, e.g., 2×4 (1.5"×3.5") studs or 2×6 (1.5"×5.5") studs. The sheets also typically include beveled edges on the longer sides (8' or 12' sides) and non-beveled edges on the shorter sides (4' sides). As is shown in FIG. 1, adjacent sheets are typically secured to the wall studs WS with fasteners such as screws or nails.

With reference to FIG. 1, the process of forming a joint typically takes place as follows: the sheets SP1 and SP2 are secured to the studs WS so that adjacent beveled edges BE overlap one of the studs WS. Fasteners F are inserted into the beveled edges BE so that the edges are tightly secured to the wall stud WS. In order to hide the fasteners F and the beveled edges BE, a fairst layer of joint compound is applied over the fasteners F and the beveled edges BE. A joint tape JT is then pressed into the first layer and covered with a second layer of joint compound JC whereupon the joint tape JT becomes embedded in the joint compound JC. Once the joint compound JC dries, it is typically sanded and covered with additional successive layers (requiring drying and sanding) which can take place over a period of days. The result is a drywall joint having a relatively wide joint width JW.

One problem with the conventional system is that it is very labor intensive and requires installers to return to the jobsite many times to complete the joints to the point that they will not be visible after painting. Another problem with the conventional system is that it requires joint compound joints (JW being typically between about 12" wide and about 24" wide). Wider joints are preferred because they feather the compound and make it virtually impossible to detect the joint areas. However, they require more joint compound and more skill. Still another problem with the conventional system is that it requires significant skill to properly center the joint tape and place it without creating folds can require even wider joints to hide.

SUMMARY OF THE INVENTION

According to one non-limiting aspect of the invention there is provided a drywall panel comprising a sheet having a first side, a back side, and oppositely arranged beveled edges, a flap arranged in an area of one of the beveled edges and having a free end which extends out beyond an end of said one of the beveled edges, and at least one of: the flap being an integral part of a facing forming the first side of the sheet and the flap being a separately formed member that is secured to a facing forming the first side of the sheet.

The sheet may comprise a rectangular shape. The sheet may comprise a length of about 8 feet, a width of about 4 feet, and a thickness of between about 0.25 inches and about 0.75 inches. The sheet may comprise a length of about 12 feet, a width of about 4 feet, and a thickness of between about 0.25 inches and about 0.75 inches. The flap may extend along an entire length of said one of the beveled edges. The sheet may have only a single flap. The flap may be less than about twice a width of a beveled portion of said one of the beveled edges. The flap may extend out beyond the end of said one of the beveled edges by an amount that is less than a width of a beveled portion of another of the beveled edges. The flap may have one end secured to a beveled portion of said one of the beveled edges. The flap may comprise the same material as the facing forming the first side of the sheet. The facing forming the first side of the sheet may comprise a paper material. The facing may comprise a single layer of material directly attached to or in contact with gypsum arranged within the panel. The flap may be a separately formed member that is secured by an adhesive to the first side of the sheet. The flap may be a separately formed member that is secured to a beveled portion of said one of the beveled edges.

According to one non-limiting aspect of the invention there is provided a drywall panel comprising a rectangular sheet having a first side, a back side, a gypsum material arranged between the first and second sides, and at least one beveled edge. A flap is arranged on only one edge of rectangular sheet. The flap has a free end which extends out beyond an end of said only one edge. At least one of the flap being an integral part of a facing forming the first side of the sheet and the flap being a separately formed member that is secured to a facing forming the first side of the sheet.

The flap may be arranged in an area of the at least one beveled edge. The flap may be less than about twice a width of a beveled portion of said at least one beveled edge. The flap may extend out beyond the end by an amount that is less than a width of a beveled portion of the at least one beveled edge. The flap may have one end secured to a beveled portion of the least one beveled edge. The flap may comprise the same material as a facing forming the first side of the sheet. The facing forming the first side of the sheet may comprise a paper material. The facing may comprise a single layer of material directly attached to or in contact with the gypsum arranged within the panel. The flap may be a separately formed member that is secured by an adhesive to the first side of the sheet. The flap may be a separately formed member that is secured to a beveled portion of the at least one beveled edge. The flap may comprise one of an adhesive substance and a substance which activates an adhesive substance, and the at least one beveled edge may comprise one of an adhesive substance and a substance which activates an adhesive substance.

According to one non-limiting aspect of the invention there is provided a drywall panel comprising a sheet having a first side, a back side, and first and second beveled edges. A flap is arranged in an area of the second beveled edge and having a free end which extends out beyond an end of said second beveled edge. At least one of the flap being an integral part of a facing forming the first side of the sheet and the flap being a separately formed member that is secured to a facing forming the first side of the sheet.

According to one non-limiting aspect of the invention there is provided a method of forming a drywall joint using two panels of the type described herein, wherein the method comprises arranging a first beveled edge of one sheet adjacent to a second beveled edge of another sheet, securing the adjacent first and second beveled edges to a stud with fasteners, covering the fasteners with the flap, and applying a joint compound over at least a portion of the flap.

According to one non-limiting aspect of the invention there is provided a method of forming a drywall joint using two panels of the type described herein, wherein the method comprises arranging a first beveled edge of one sheet adjacent to a second beveled edge of another sheet, moving the free end of the flap away from the first beveled edge, securing the adjacent first and second beveled edges to a stud with fasteners, covering the fasteners with the flap, and applying a joint compound over at least a portion of the flap.

According to one non-limiting aspect of the invention there is provided a method of forming a drywall joint using two panels of the type described herein, wherein the method comprises arranging a first beveled edge of one sheet adjacent to a second beveled edge of another sheet, securing the adjacent first and second beveled edges to a stud with fasteners, covering the fasteners with the flap, and applying a joint compound over at least a portion of the flap and over at least a portion of the first beveled edge.

According to one non-limiting aspect of the invention there is provided a method of forming a drywall joint using two panels of the type described herein, wherein the method comprises arranging a first beveled edge of one sheet adjacent to a second beveled edge of another sheet, securing the adjacent first and second beveled edges to a stud with fasteners, applying a joint compound over at least a portion of the first and second beveled edges, covering the fasteners with the flap, and applying a joint compound over at least a portion of the flap and over at least a portion of the first beveled edge.

According to one non-limiting aspect of the invention there is provided a method of forming a drywall joint using two panels of the type described herein, wherein the method comprises arranging a first beveled edge of one sheet adjacent to a second beveled edge of another sheet, securing the adjacent first and second beveled edges to a stud, securing at least a portion of the flap to at least a portion of the first beveled edge, and applying a joint compound over at least a portion of the flap and over at least a portion of the first beveled edge.

According to one non-limiting aspect of the invention there is provided a method of forming a drywall joint using two panels of the type described herein, wherein the method comprises arranging a first beveled edge of one sheet adjacent to a second beveled edge of another sheet, securing the at least a portion of the flap to at least a portion of the first beveled edge, securing the adjacent first and second beveled edges to a stud, and applying a joint compound over at least a portion of the flap and over at least a portion of the first beveled edge.

According to one non-limiting aspect of the invention there is provided a method of forming a drywall joint using two panels of the type described herein, wherein the method comprises arranging a first beveled edge of one sheet adjacent to a second beveled edge of another sheet, adhesively securing at least a portion of the flap to at least a portion of the first beveled edge, securing the adjacent first and second beveled edges to a stud with fasteners, and applying a joint compound over at least a portion of the flap.

According to one non-limiting aspect of the invention there is provided a method of forming a drywall joint using two panels of the type described herein, wherein the method comprises arranging a first beveled edge of one sheet adjacent to a second beveled edge of another sheet, securing the adjacent first and second beveled edges to a stud with fasteners, applying a joint compound over at least the fasteners, and applying a joint compound over at least a portion of the flap.

The invention contemplates using any one or more of the features of one embodiment on any one or all of the other embodiments.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE INVENTION

Figure 1:
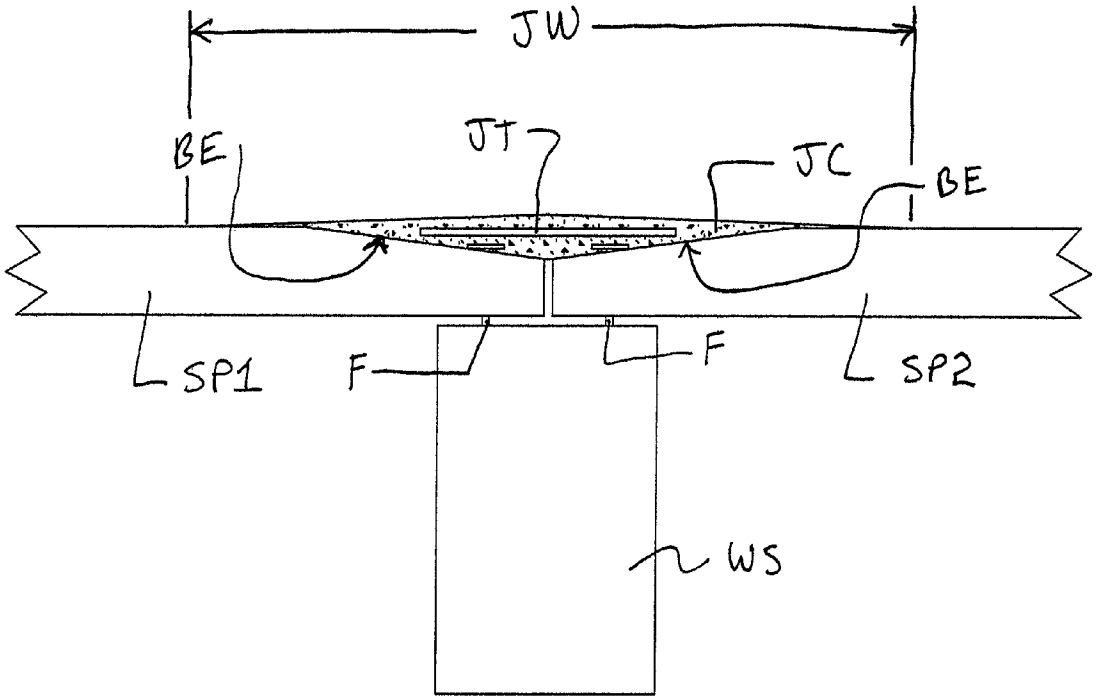
PRIOR ART Fig. 1
FIG. 1 shows a side view of a conventional drywall joint.
Figure 2:
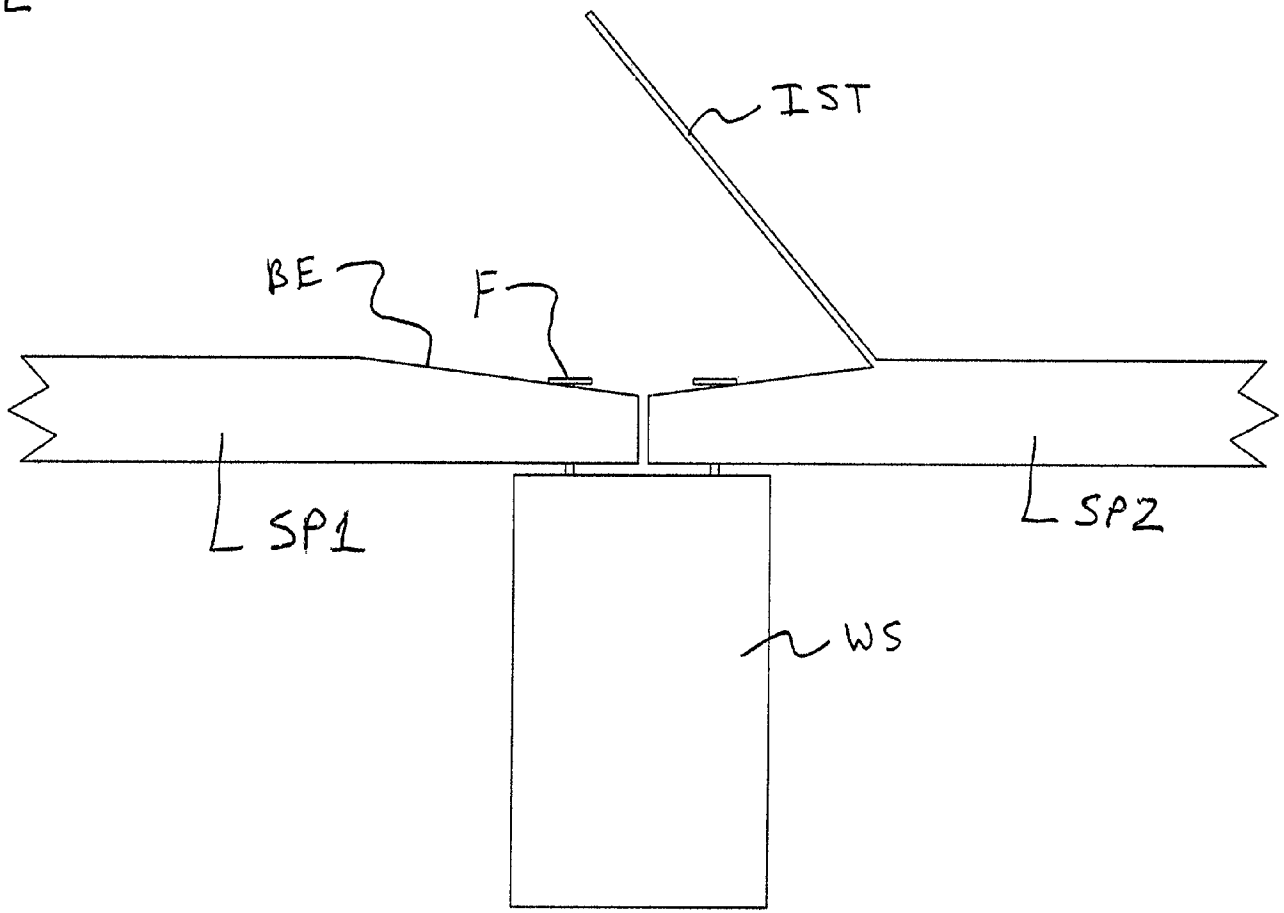
FIG. 2 shows a side view of a partially formed drywall joint according to one embodiment of the invention and after the flap is lifted in order to allow a user to install the securing fasteners.
Figure 3:
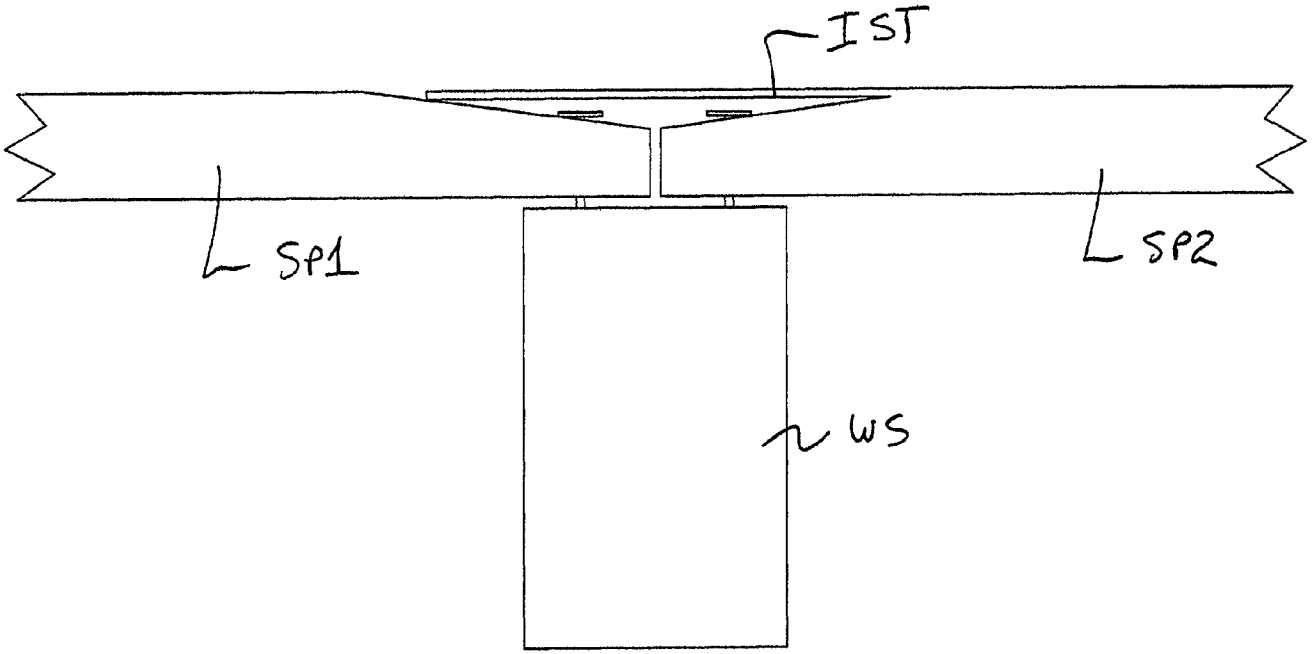
FIG. 3 shows a side view of the drywall joint of FIG. 2 after the flap is allowed to return to an original position.

Referring now to the drawings and first to FIGS. 1-6 which shows a first non-limiting embodiment of a drywall joint according to the invention. The drywall joint is formed between adjacent beveled edges BE of two drywall panels SP1 and SP2. As in prior art FIG. 1, the beveled edges BE of the two panels SP1 and SP2 are secured to a wall stud WS via fasteners such as, e.g., drywall screws or nails. The process of securing the two panels SP1 and SP2 to the stud WS can take place as follows: the user secures panel SP1 to a number of wall studs including the beveled edge BE of the first panel SP1 with fasteners F. Then, the user abuts the flap-side beveled edge BE of the second panel SP2 against the beveled edge BE of the first panel SP1. Next, as shown in FIG. 2, the user lifts the flap or integral securing tape IST to expose the beveled edge BE of the second panel SP2 and secures the beveled edge BE to the wall stud WS. The user can then allow the flap IST to move back to its original or natural position as shown in FIG. 3. The user can then install all of the panels in a particular jobsite in the same way.

Figure 4:
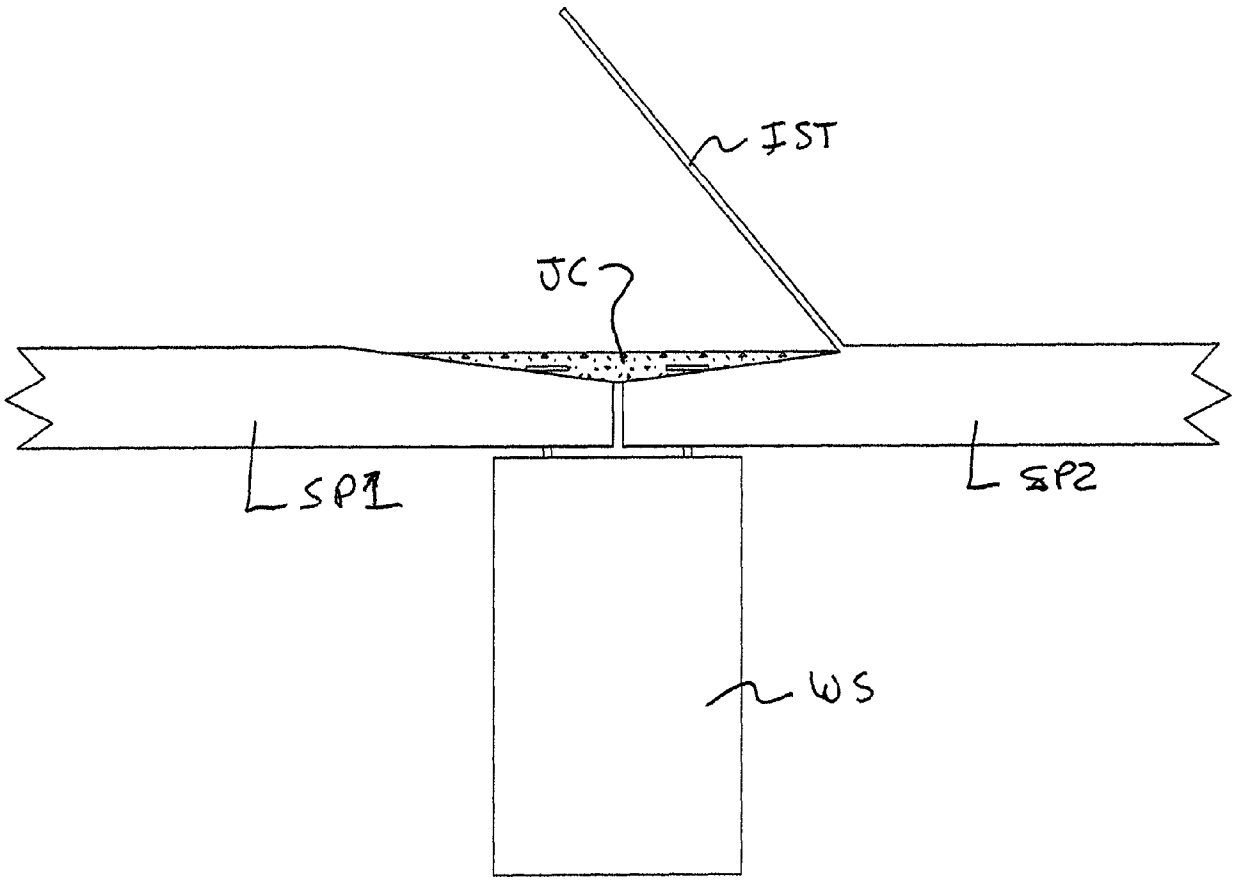
FIG. 4 shows a side view of the drywall joint of FIG. 2 after the flap is lifted in order to allow a user to install a first layer of joint compound over the beveled edges, the fasteners, and the area where the edges of the sheets abut one another.
Figure 5:
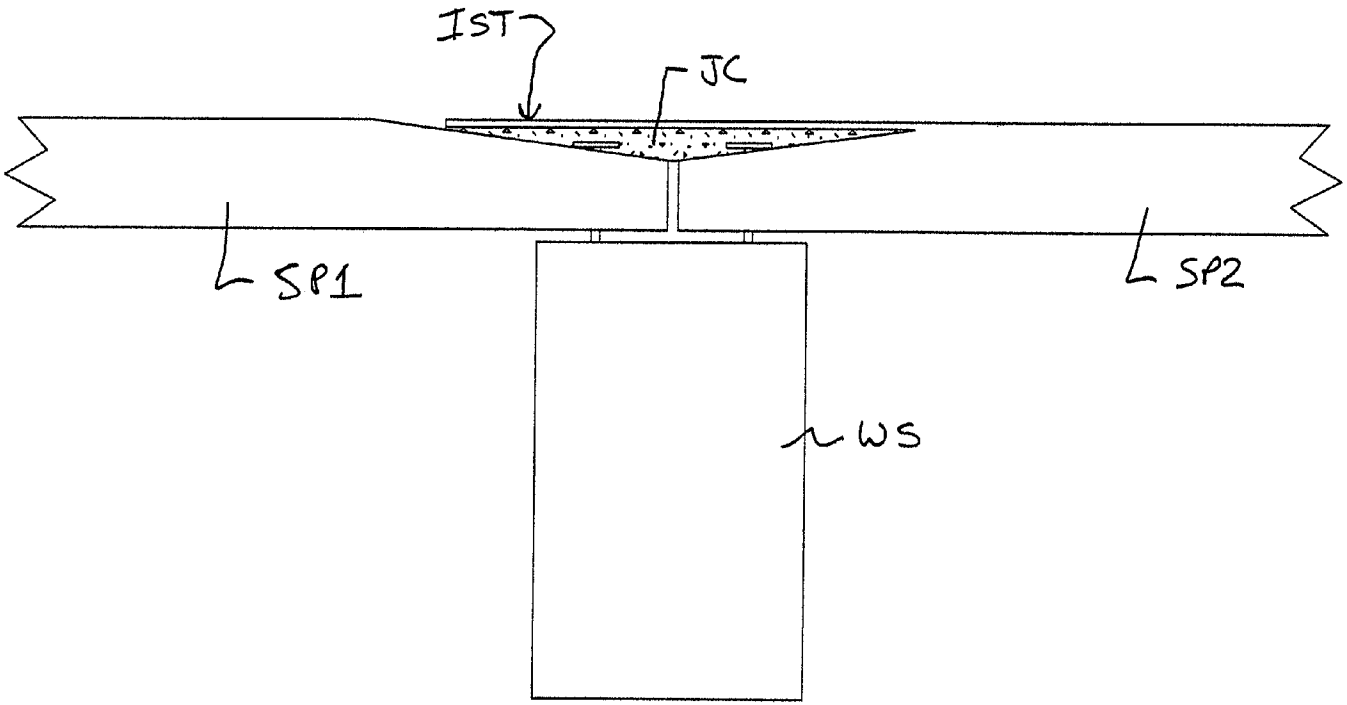
FIG. 5 shows a side view of the drywall joint of FIG. 4 after the flap is allowed to return to an original position.
Figure 6:
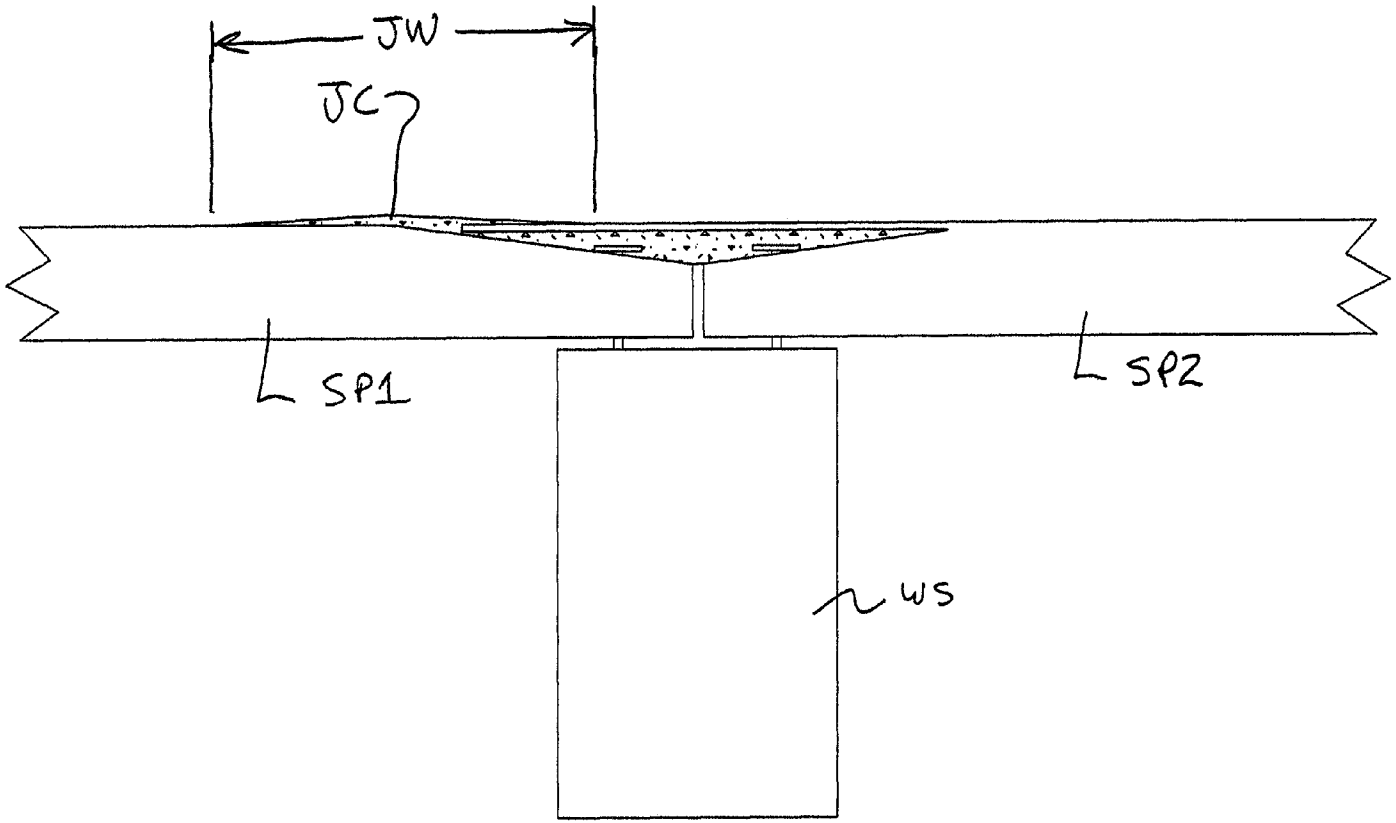
FIG. 6 shows a side view of the drywall joint of FIG. 5 after the user installs a second layer of joint compound over area where the free end of the flap meets to planar surface of the adjacent sheet. The joint is now ready for sanding and painting.

When the user is ready apply joint compound JC to the joints, the user can simply lift the flaps IST and apply a first layer of joint compound JC over the adjacent beveled edges BE, the fasteners F, and the area where the edges of the sheets abut one another as is shown in FIG. 4. The user can then allow the flap IST to return to an original position and go over the flap area with the tool which applies the joint compound JC. This will ensure that the flap IST makes full securing contact with the underlying first layer of joint compound JC. Finally, as shown in FIG. 6, the user installs a second layer of joint compound JC over area where the free end of the flap IST meets the planar surface of the adjacent sheet SP1. The user can either wait until the first layer of joint compound JC (see FIG. 5) hardens to apply the second layer (see FIG. 6), or the user can perform the steps shown in FIGS. 5 and 6 essentially at the same time. Once the joint compound has hardened (which typically occurs in one day), the joint should be ready for sanding and painting. Of course, if the user desires, additional layers of joint compound JC can be applied over the joint formed in FIG. 6. However, this should not be necessary if the steps of FIGS. 5 and 6 are performed properly. Furthermore, although FIG. 6 shows a joint width JW that is substantially smaller than that of the prior art (see FIG. 1), the invention contemplates making the joint width JW wider than that shown in FIG. 6, including widths which are used in conventional drywall joints such as that shown in FIG. 1. By way of non-limiting example, the joint width JW of the joint shown in FIG. 6 can be between about 2 inches and about 8 inches, and is preferably between about 2 inches and about 6 inches, and is most preferably between about 2 inches and about 4 inches.

Figure 7:
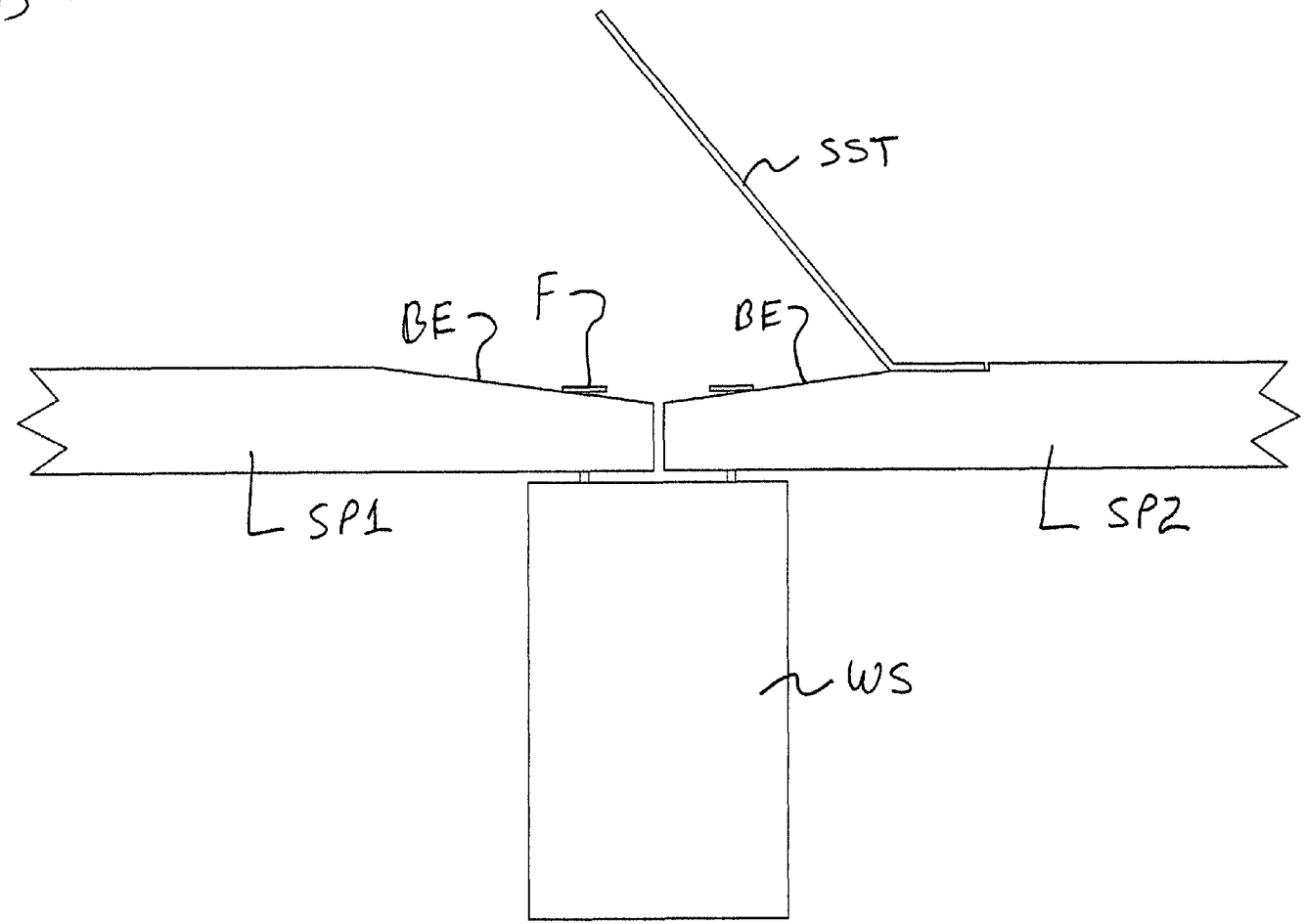
FIG. 7 shows a side view of a partially formed drywall joint according to another embodiment of the invention and after the separately formed flap is lifted in order to allow a user to install the securing fasteners.

FIG. 7 shows another drywall joint according to the invention. The drywall joint is formed between adjacent beveled edges BE of two drywall panels SP1 and SP2. As in prior art FIG. 1, the beveled edges BE of the two panels SP1 and SP2 are secured to a wall stud WS via fasteners F. The joint shown in FIG. 7 can be formed in the same way as that shown in FIGS. 1-6, except that the user can also place some joint compound JC also in an area where the separately formed flap SST is secured to the panel SP2 to hide any indication that the joint between the flap SST and the panel SP2. The invention contemplates securing the separately formed flap SST to the panel SP2 in a factory setting using e.g., an adhesive bonding connection or alternatively by the user at a jobsite. In the latter case, the user can purchase a roll of the flap material SST, remove a backing material (not shown) attached to the portion of the tape SST which will be secured to the panel SP2, and then attach the same. The tape SST can preferably be attached after the panel SP2 is secured to the stud WS with fasteners F.

Figure 8:
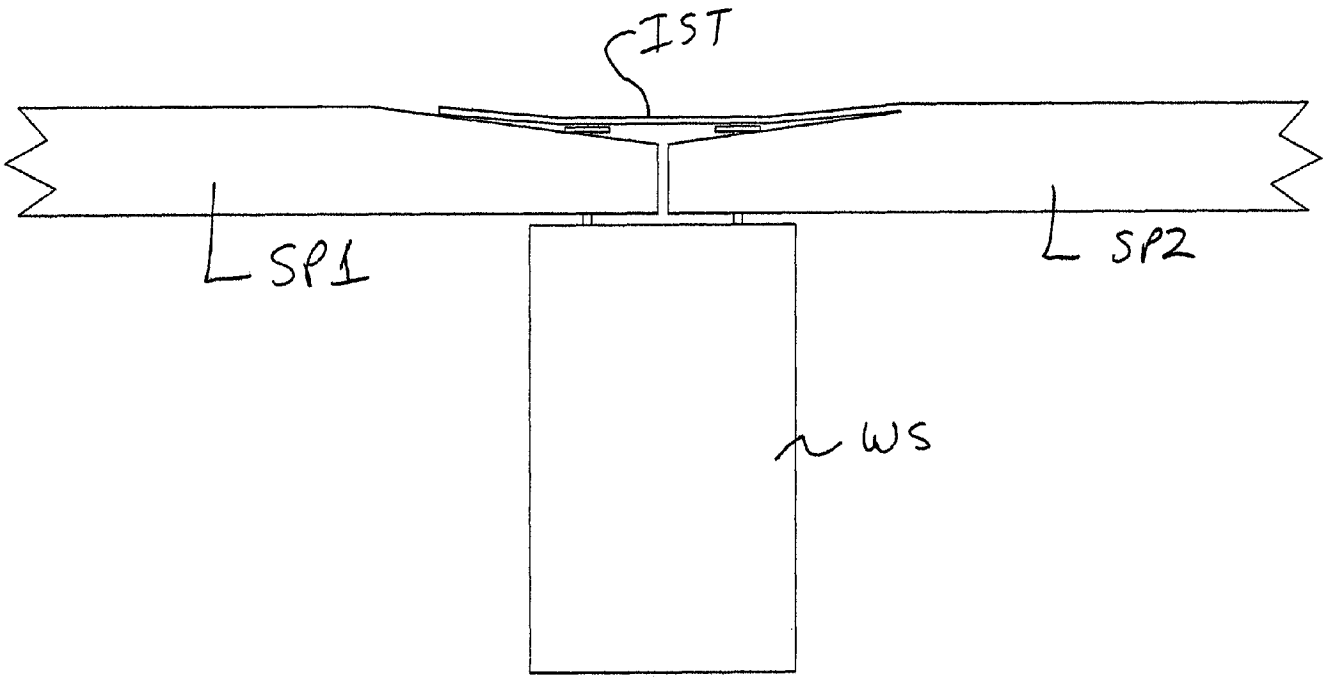
FIG. 8 shows a side view of a partially formed drywall joint according to another embodiment of the invention. This embodiment is similar to that of FIG. 2 except that the integrally formed flap is adhesively secured over the beveled edges and fasteners.
Figure 9:
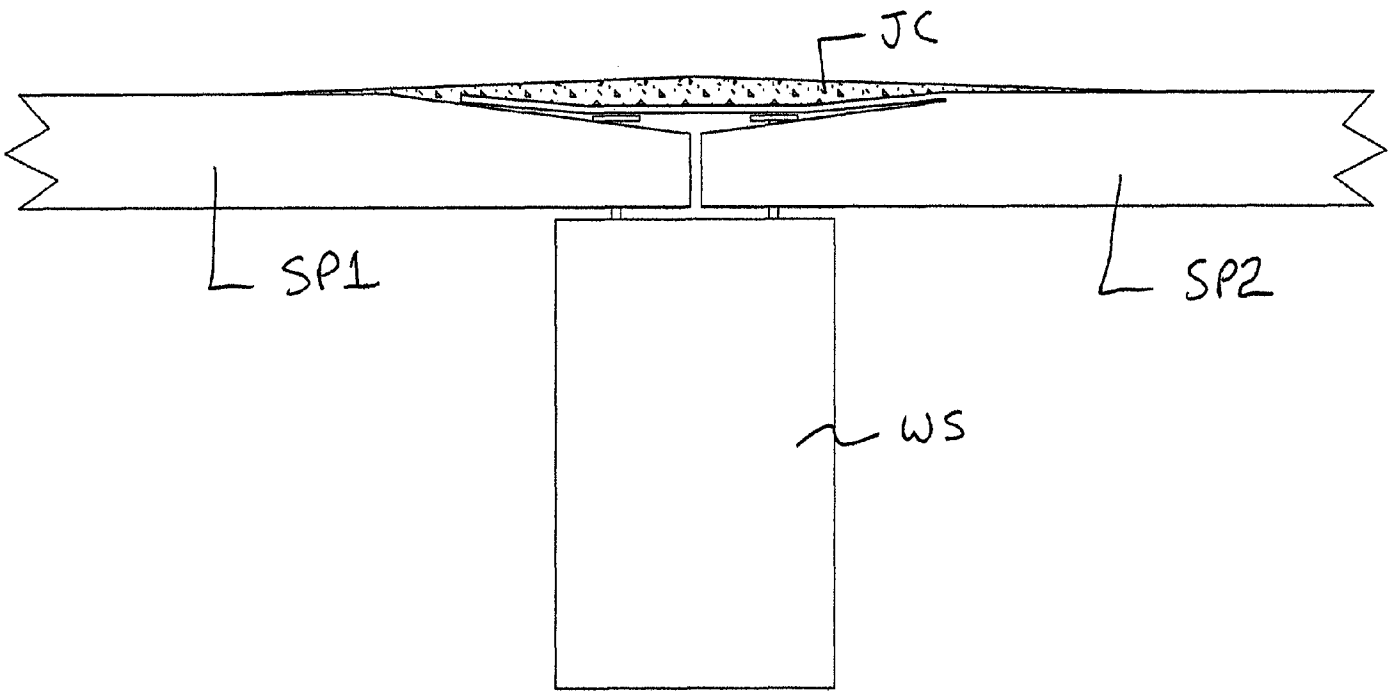
FIG. 9 shows a side view of the drywall joint of FIG. 8 after the user installs a finish layer of joint compound over the joint area. The joint is now ready for sanding and painting.

Referring now to FIGS. 8 and 9 which shows another non-limiting embodiment of a drywall joint according to the invention. The drywall joint is formed between adjacent beveled edges BE of two drywall panels SP1 and SP2. As in prior art FIG. 1, the beveled edges BE of the two panels SP1 and SP2 are secured to a wall stud WS via fasteners such as, e.g., drywall screws or nails. The process of securing the two panels SP1 and SP2 to the stud WS can take place as follows: the user secures panel SP1 to a number of wall studs including the beveled edge BE of the first panel SP1 with fasteners F. Then, the user abuts the flap-side beveled edge BE of the second panel SP2 against the beveled edge BE of the first panel SP1. Next, the user lifts the flap or integral securing tape IST to expose the beveled edge BE of the second panel SP2 and secures the beveled edge BE to the wall stud WS. The user can then allow the flap IST to move back to its original or natural position. The user can then install all of the panels in a particular jobsite in the same way.

When the user is ready apply joint compound JC to the joints, the user can simply lift the flaps IST and apply a first layer of joint compound JC over the adjacent beveled edges BE, the fasteners F, and the area where the edges of the sheets abut one another. The user can then allow the flap IST to return to an original position and go over the flap area with the tool which applies the joint compound JC. This will ensure that the flap IST makes full securing contact with the underlying first layer of joint compound JC. Preferably, however, the user applies an adhesive (using e.g., a spray, brush, or roll) over the beveled edges BE and then presses or rolls the flap IST against the beveled edges BE to cause the flap IST to adhesively attached to the beveled edges BE as shown in FIG. 8. Then, as shown in FIG. 9, the user installs a layer of joint compound JC over the joint area. The user can either wait until the adhesive takes before joint compound JC is applied, or the user can perform the steps shown in FIGS. 8 and 9 essentially at the same time. Once the joint compound has hardened (which typically occurs in one day), the joint should be ready for sanding and painting. Of course, if the user desires, additional layers of joint compound JC can be applied over the joint formed in FIG. 9. However, this should not be necessary if the steps of FIGS. 8 and 9 are performed properly. The invention contemplates making the joint width of the joint in FIG. 9 wider than that shown in FIG. 9, including widths which are used in conventional drywall joints such as that shown in FIG. 1.

Figure 10:
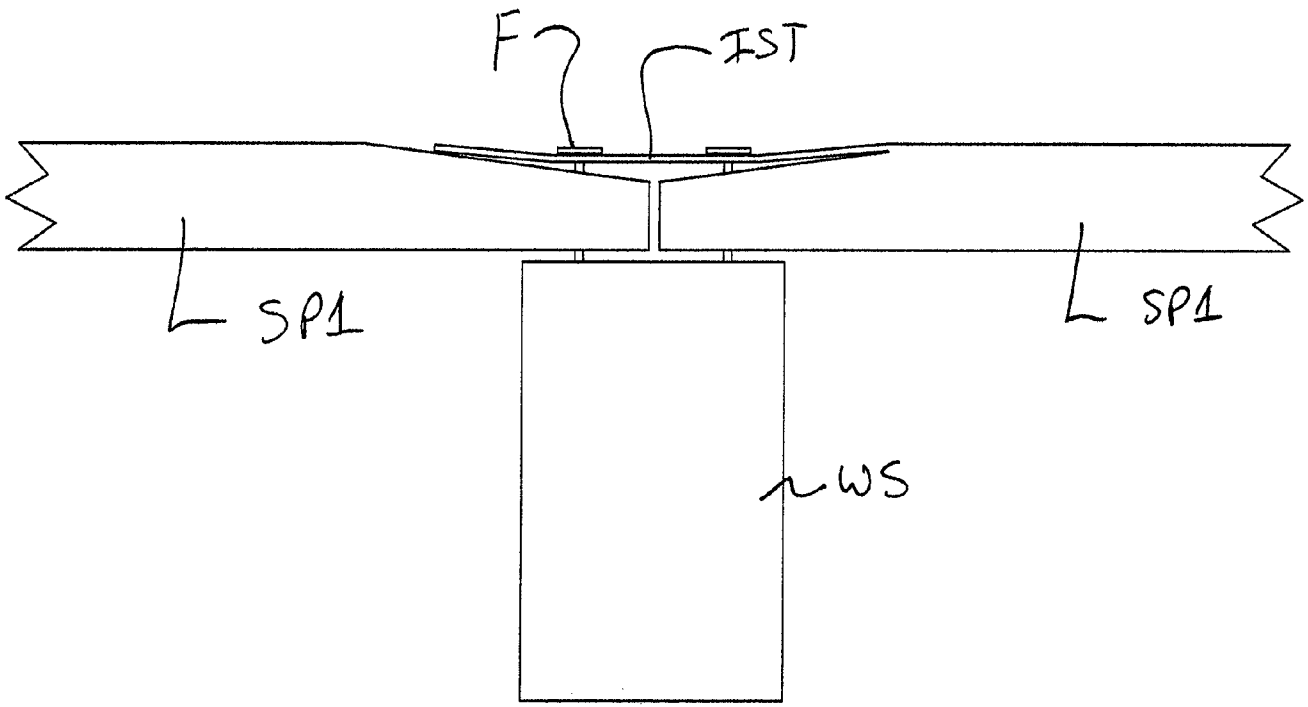
FIG. 10 shows a side view of a partially formed drywall joint according to another embodiment of the invention. This embodiment is similar to that of FIG. 2 except that the integrally formed flap is adhesively secured over the beveled edges and fasteners are installed over the flap and after the flap is secured.
Figure 11:
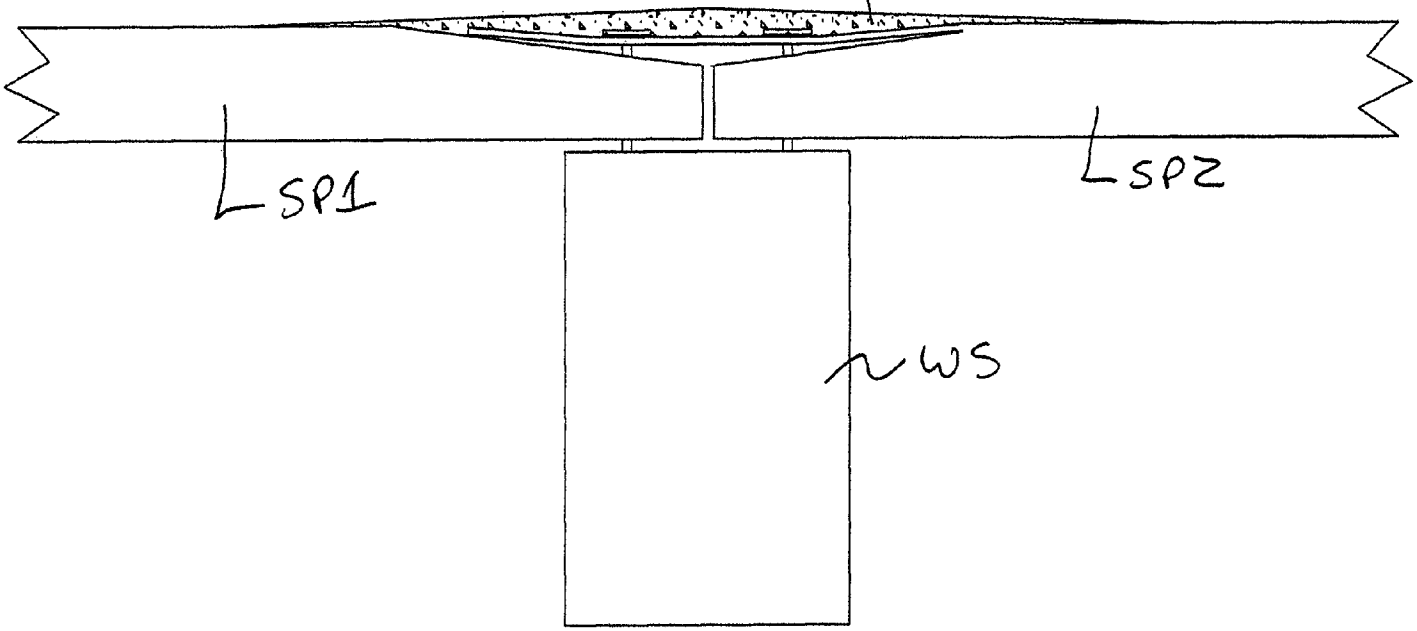
FIG. 11 shows a side view of the drywall joint of FIG. 10 after the user installs a finish layer of joint compound over the joint area. The joint is now ready for sanding and painting.

Referring now to FIGS. 10 and 11 which shows another non-limiting embodiment of a drywall joint according to the invention. The drywall joint is formed between adjacent beveled edges BE of two drywall panels SP1 and SP2. As in prior art FIG. 1, the beveled edges, BE of the two panels SP1 and SP2 are secured to a wall stud WS via fasteners such as, e.g., drywall screws or nails. The process of securing the two panels SP1 and SP2 to the stud WS can take place as follows: the user secures panel SP1 to a number of wall studs except for the beveled edge BE of the first panel SP1. Then, the user abuts the flap-side beveled edge BE of the second panel SP2 against the beveled edge BE of the first panel SP1. Next, the user secures the beveled edges BE of both panels SP1 and SP2 to the wall stud WS by installing the fasteners through the flap IST. The user can then install all of the panels in a particular jobsite in the same way.

When the user is ready apply joint compound JC to the joints, the user can simply apply, as shown in FIG. 11, a layer of joint compound JC over the joint area. Once the joint compound JC has hardened (which typically occurs in one day), the joint should be ready for sanding and painting. Of course, if the user desires, additional layers of joint compound JC can be applied over the joint formed in FIG. 11. However, this should not be necessary if the steps of FIGS. 10 and 11 are performed properly. The invention contemplates making the joint width of the joint in FIG. 11 wider than that shown in FIG. 11, including widths which are used in conventional drywall joints such as that shown in FIG. 1.

Figure 12:
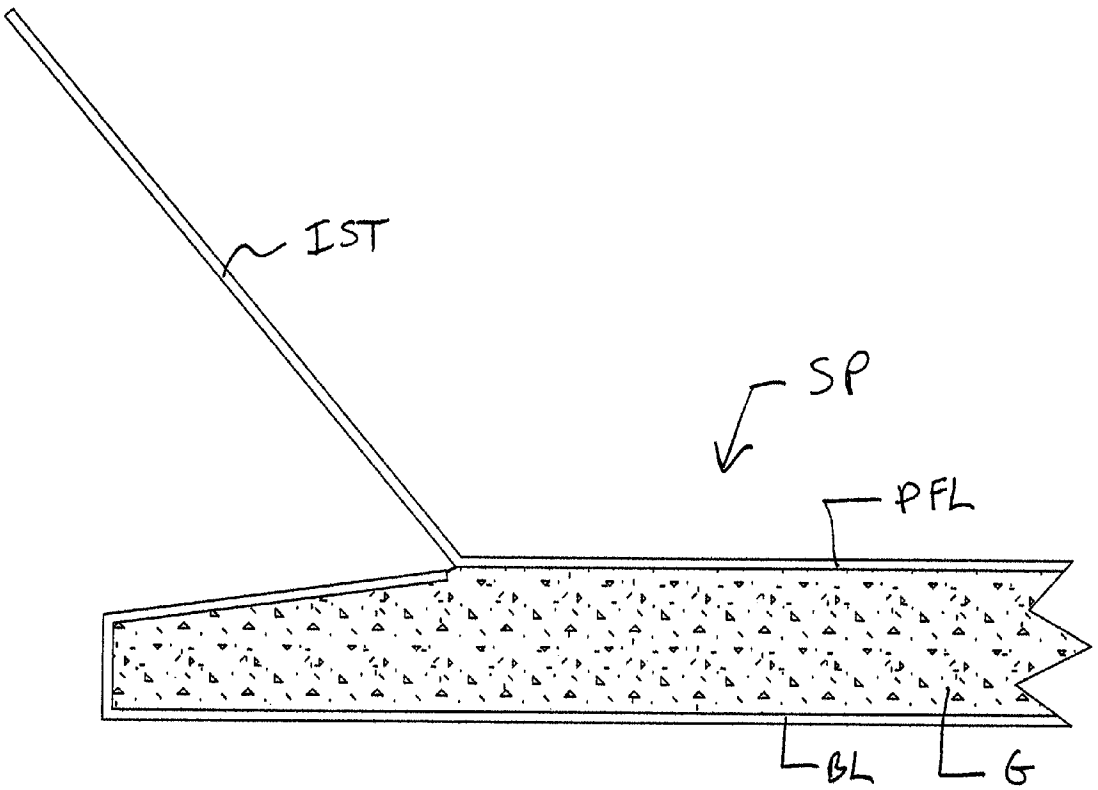
FIG. 12 shows an enlarged side view of one of the panel edges according to one embodiment of the invention and illustrates how the integrally formed tape may have the form of a deflectable flap made by extending a portion of the paintable facing layer over the beveled edge area. In such embodiments, the paintable facing layer and the backing layer may be secured to and/or in direct contact with a gypsum material.

FIG. 12 shows an enlarged side view of one of the panel edges according to the embodiment of, e.g., FIGS. 1-6, and illustrates how the integrally formed tape IST has the form of a deflectable flap made by extending a portion of the paintable facing layer PFL over the beveled edge area. The paintable facing layer PFL and the backing layer BL are secured to and/or in direct contact with a gypsum material G.

Figure 13:
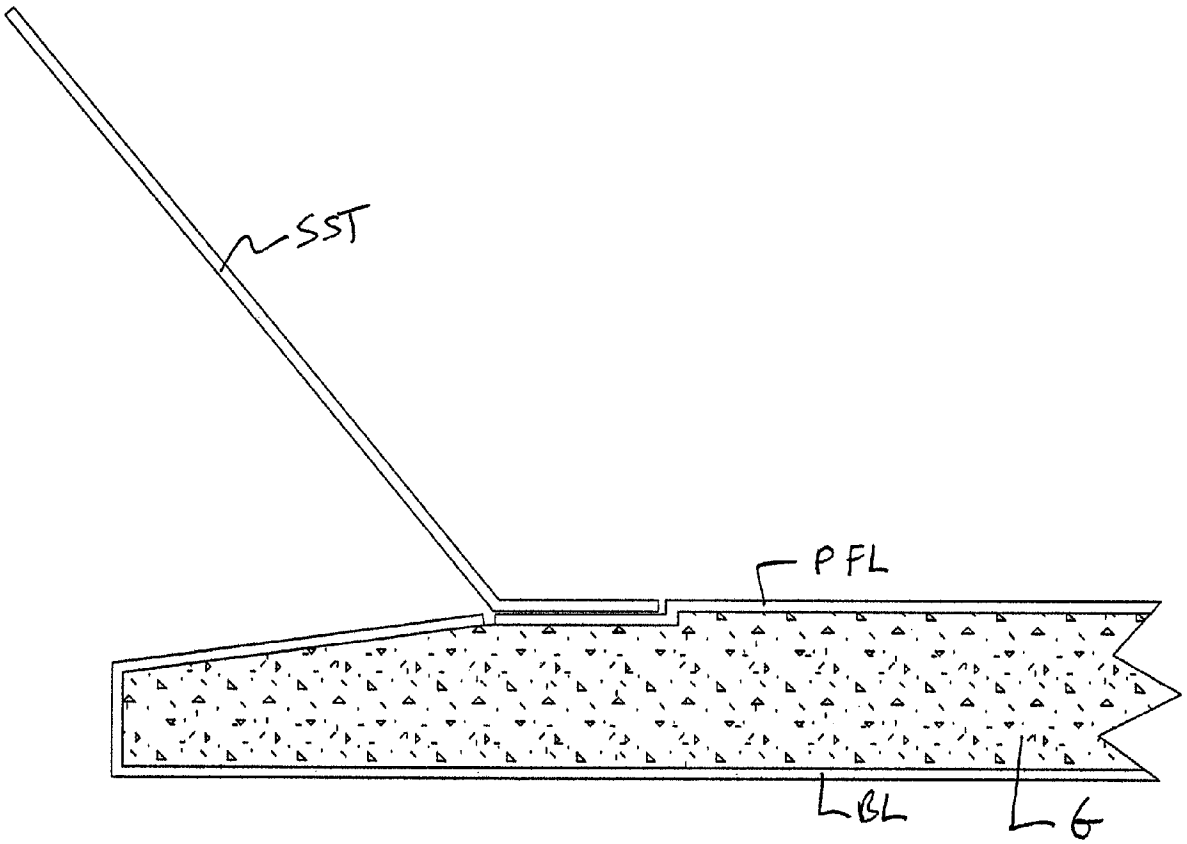
FIG. 13 shows an enlarged side view of one of the panel edges according to another embodiment of the invention and illustrates how a separately formed tape may have the form of a deflectable flap made by securing one end of the tape to a recessed portion of the facing layer. The paintable facing layer and the backing layer may be secured to and/or in direct contact with a gypsum material.

FIG. 13 shows an enlarged side view of one of the panel edges according to another embodiment of the invention and illustrates how a separately formed tape SST has the form of a deflectable flap made by securing one end of the tape SST to a recessed portion of the facing layer PFL. The paintable facing layer PFL and the backing layer BL are secured to and/or in direct contact with a gypsum material G.

Figure 14:
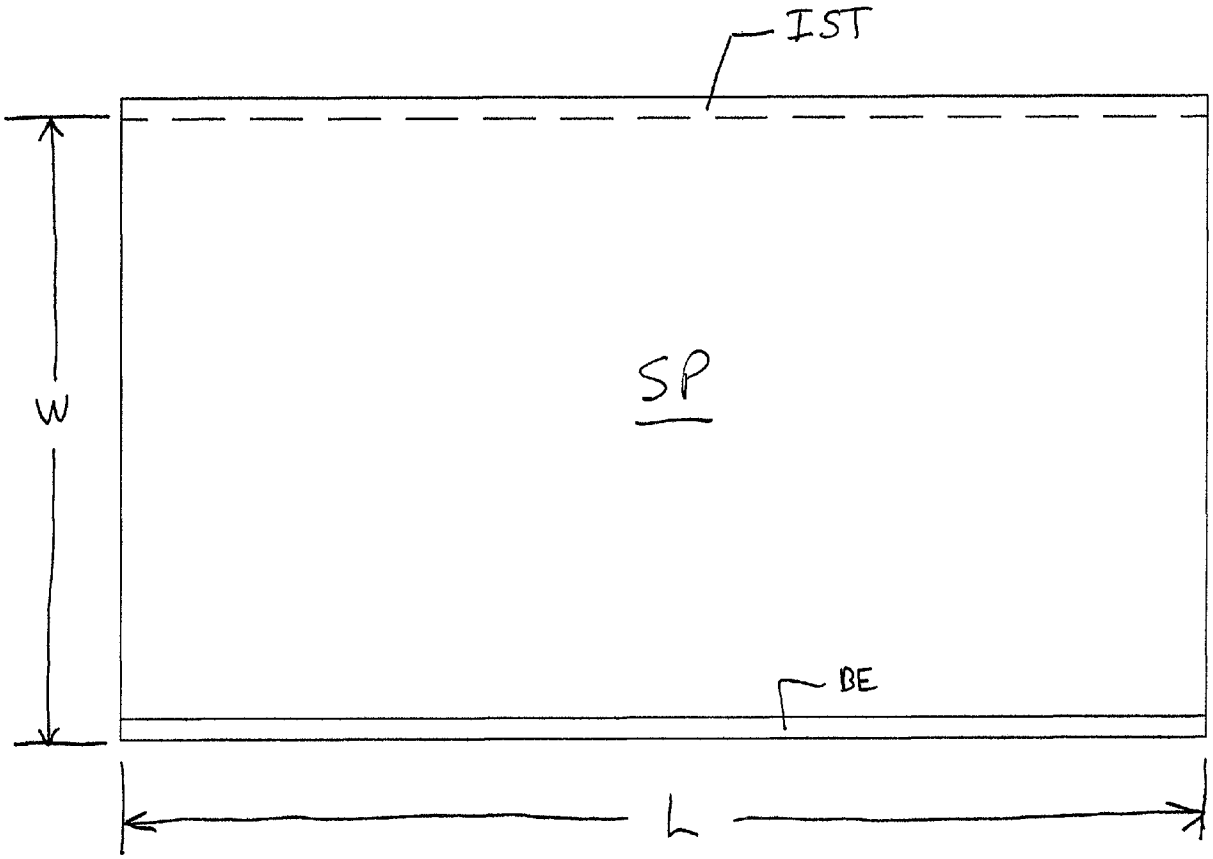
FIG. 14 shows a front view of a drywall panel according to one embodiment of the invention.
Figure 15:
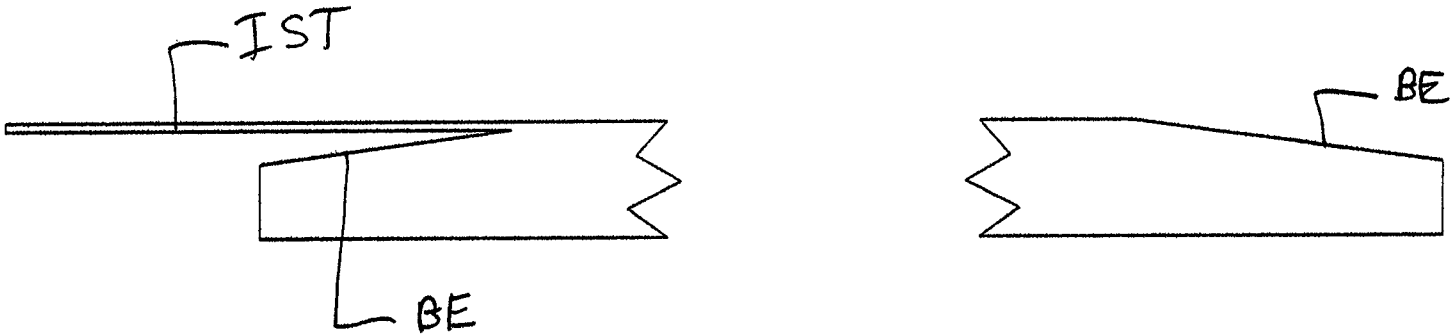
FIG. 15 shows a side view of the drywall panel of FIG. 14 and illustrates the oppositely arranged beveled edges.

FIG. 14 shows a front view of a drywall panel SP according to one embodiment, e.g., FIGS. 1-6, of the invention. The panel SP has the form of a width W of 4 foot and a length L of 8 foot. FIG. 15 shows a side view of the drywall panel of FIG. 14 and illustrates the oppositely arranged beveled edges BE.

Figure 16:
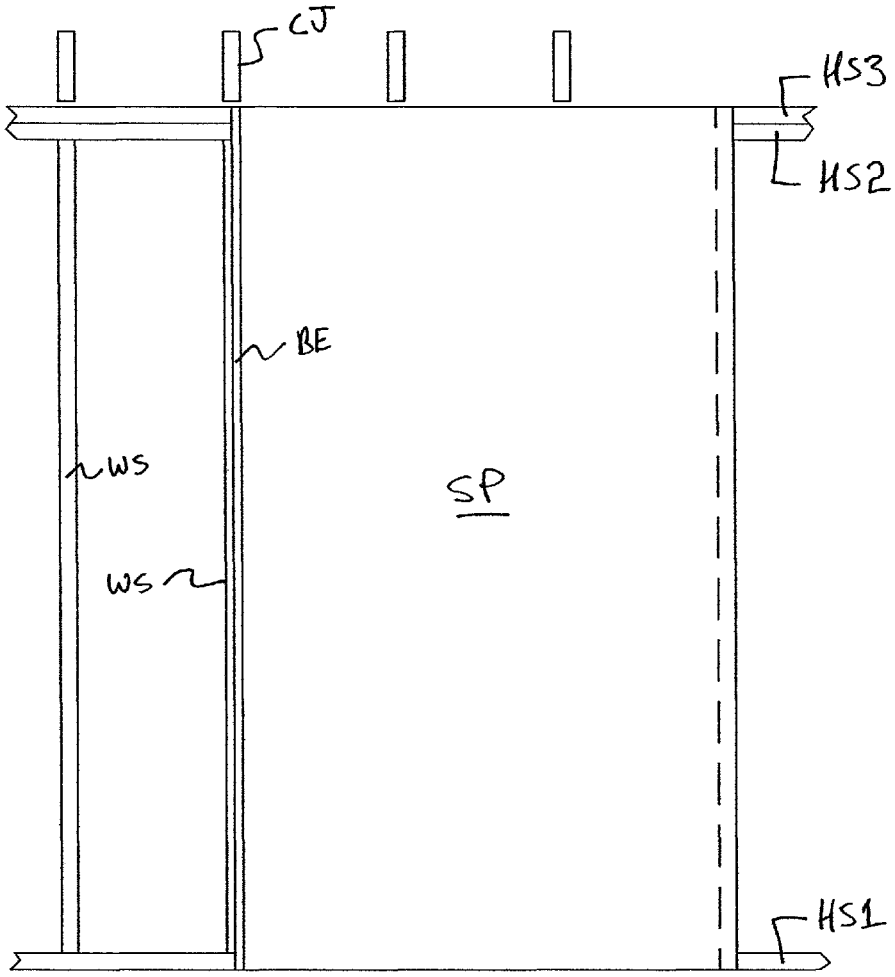
FIG. 16 shows one way in which the drywall panel of FIG. 14 can be used to cover an eight foot stud wall. The figure shows vertically arranged wall studs arranged 16 inches on center between a first horizontal stud which will be secured to a floor and two horizontal studs which will serve to support a plurality of horizontal ceiling joists also arranged 16 inches on center (although other spacings, of course, can be used)

FIG. 16 shows one way in which the drywall panel SP of FIG. 14 can be used to cover an eight foot stud wall. The figure shows vertically arranged wall studs WS arranged, e.g., 16 inches on center, between a first horizontal stud HS1 which will be secured to a floor and two horizontal studs HS2 and HS3 which will serve to support a plurality of horizontal ceiling joists CJ also arranged, e.g., 16 inches on center.

Figure 17:
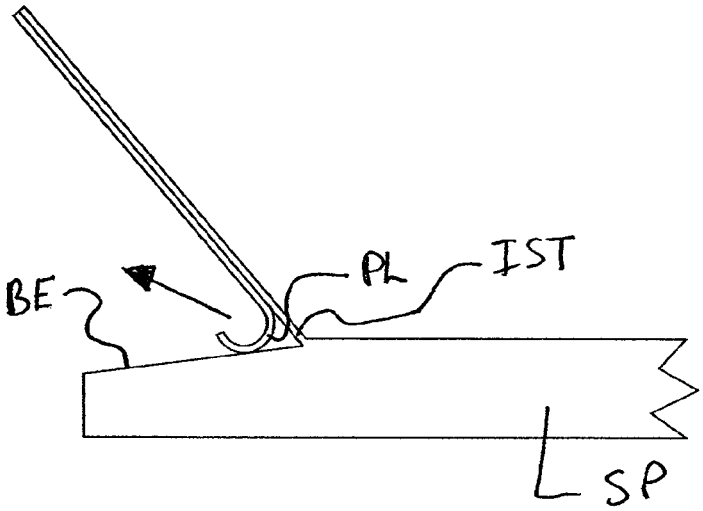
FIG. 17 shows a side view of a panel edge area according to another embodiment of the invention. This embodiment is similar to that of FIG. 12 except that the integrally formed securing tape or flap includes a removable and/or peelable layer which when removed exposes the adhesive arranged on the securing surface of the flap.
Figure 18:
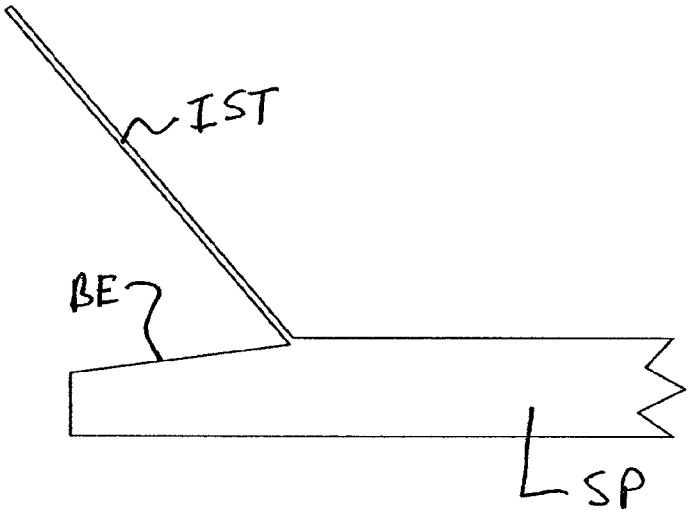
FIG. 18 shows a side view of FIG. 17 after the removable and/or peelable layer is removed to expose the securing surface of the flap.

FIG. 17 shows a side view of a panel edge area according to another embodiment of the invention. This embodiment is similar to that of FIG. 12 except that the integrally formed securing tape or flap IST includes a removable and/or peelable layer PL which when removed exposes an adhesive layer arranged on the securing surface of the flap IST. FIG. 18 shows a side view of FIG. 17 after the removable and/or peelable layer PL is removed to expose the securing surface of the flap IST.

Figure 19:
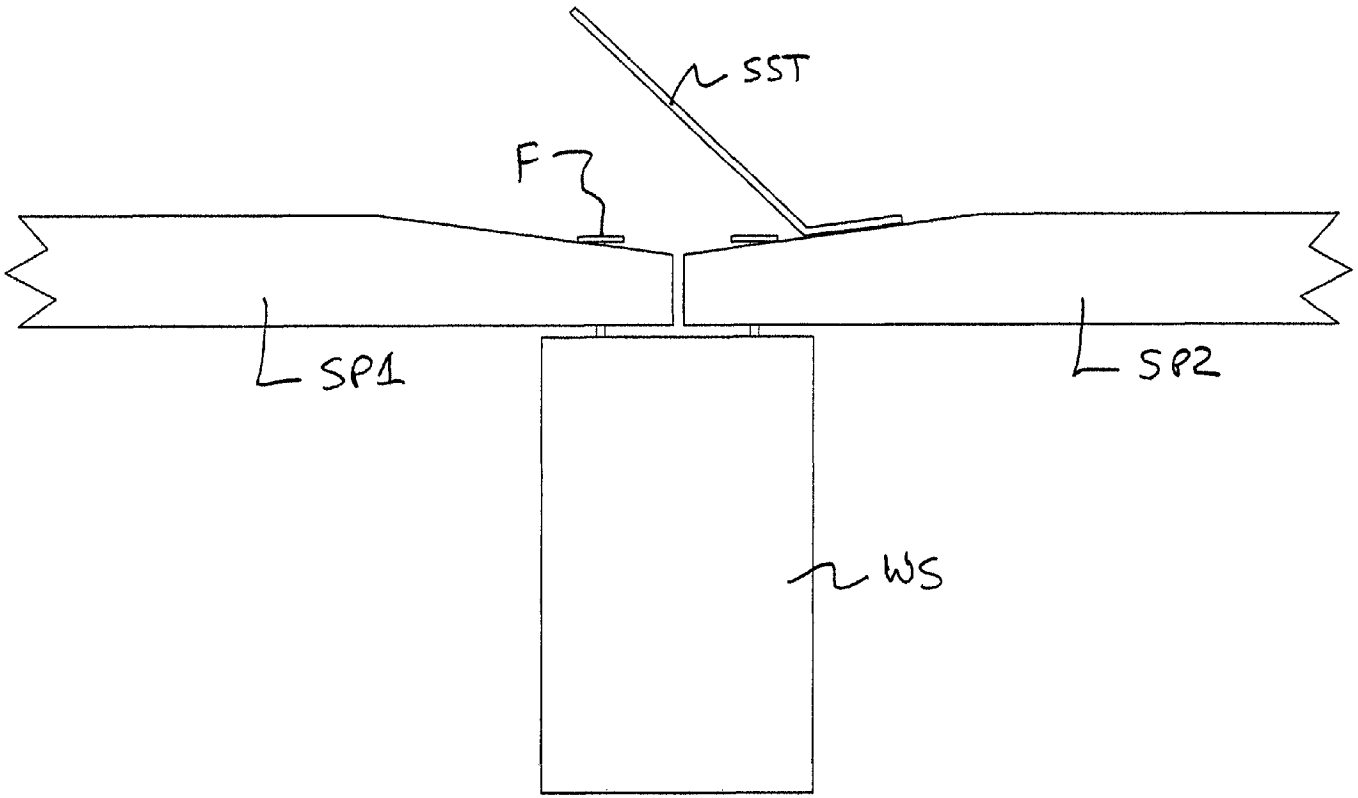
FIG. 19 shows a side view of a partially formed drywall joint according to another embodiment of the invention. This embodiment is similar to that of FIG. 7 except that the separately formed flap may be secured to the beveled portion of one of the beveled edges.
Figure 20:
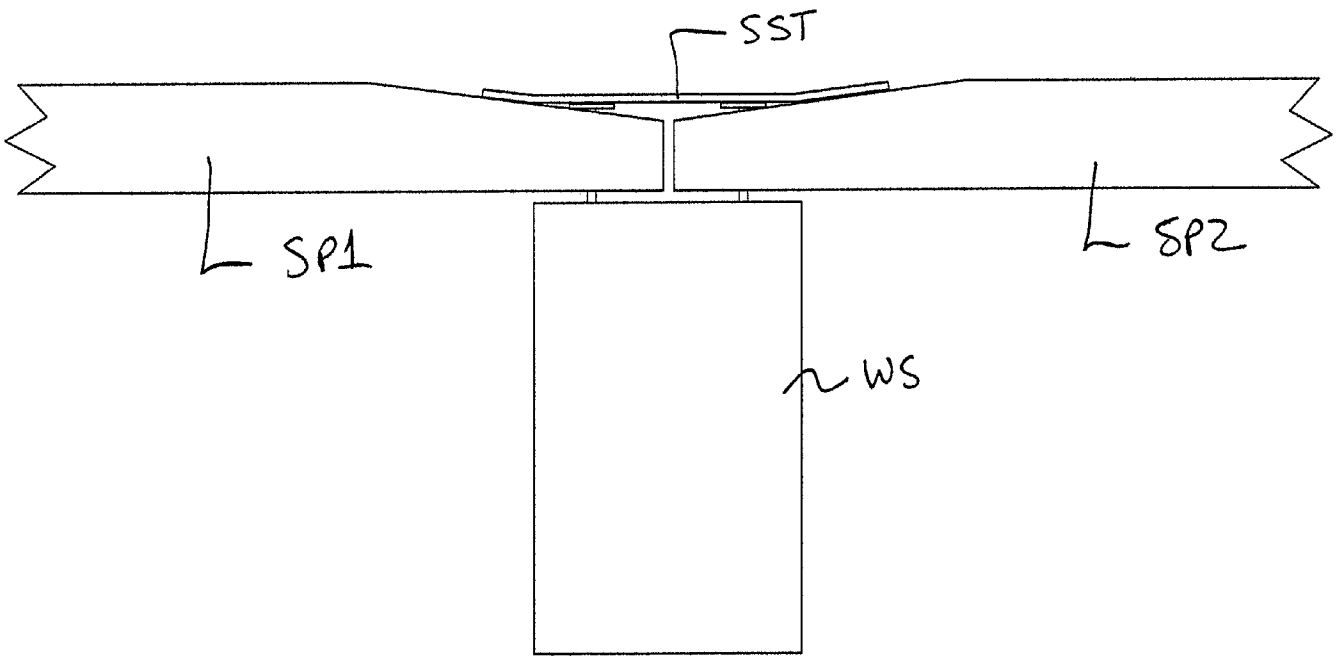
FIG. 20 shows one non-limiting way in which the flap shown in FIG. 19 can be secured to the beveled edge of an adjacent panel.
Figure 21:
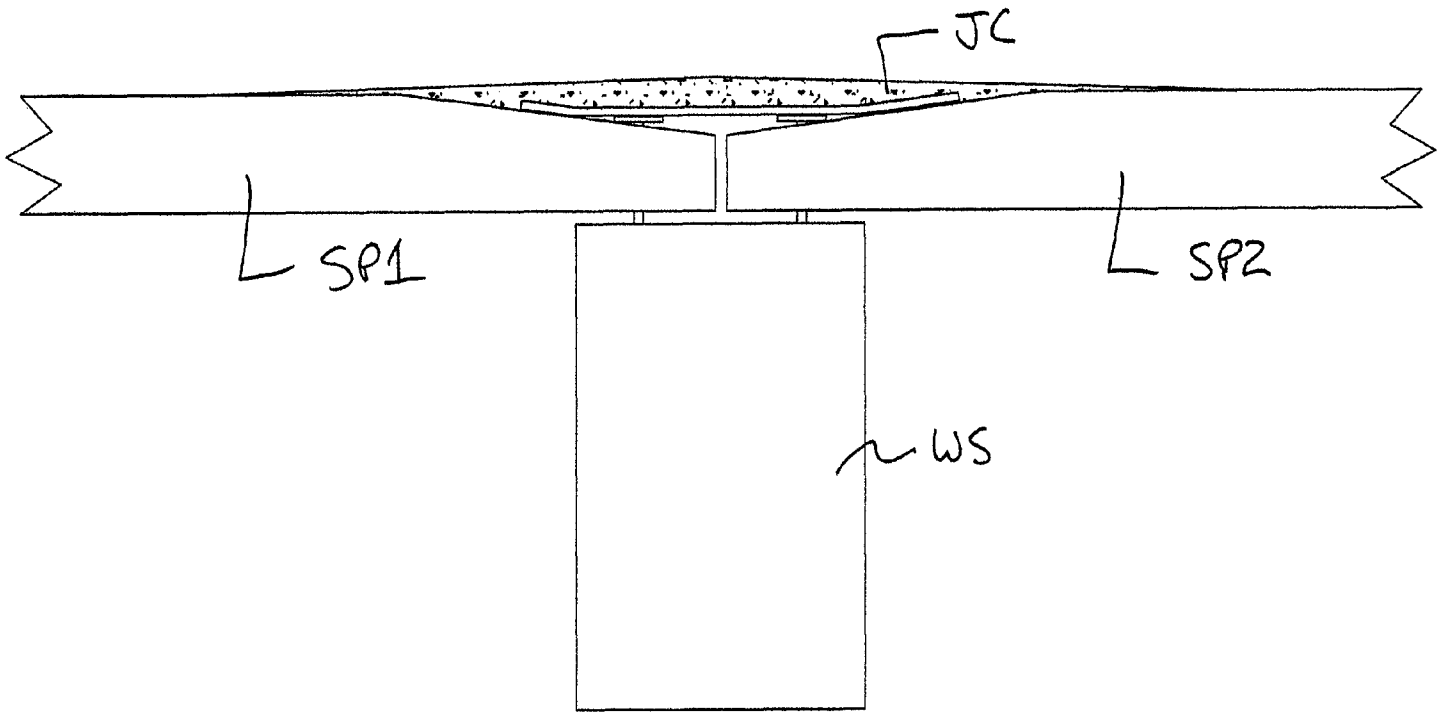
FIG. 21 shows a side view of the drywall joint of FIGS. 19 and 20 after the user installs a finish layer of joint compound over the joint area. The joint is now ready for sanding and painting.

FIG. 19 shows a side view of a partially formed drywall joint according to another embodiment of the invention. This embodiment is similar to that of FIG. 7 except that the separately formed flap SST is secured to the beveled portion of the beveled edge BE of panel SP2. FIG. 20 shows one non-limiting way in which the flap IST shown in FIG. 19 can be secured to the beveled edge of an adjacent panel SP1 using e.g., a spray on adhesive. FIG. 21 shows a side view of the drywall joint of FIGS. 19 and 20 after the user installs a finish layer of joint compound JC over the joint area. The joint is now ready for sanding and painting.

Figure 22:
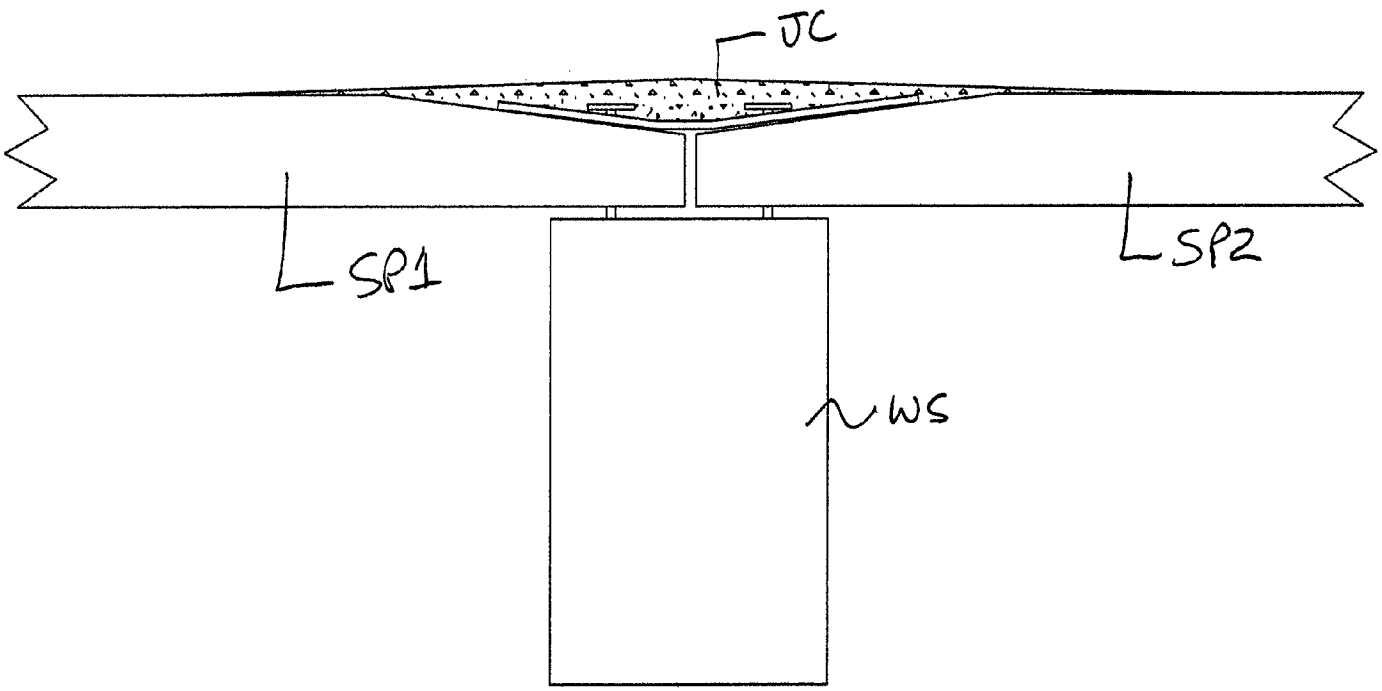
FIG. 22 shows a side view of a fully formed drywall joint according to another embodiment of the invention. This embodiment is similar to that of FIGS. 19-21 except that the separately formed flap may be secured to the beveled portion of one of the beveled edges before the fasteners secure the beveled edges to the stud.

FIG. 22 shows a side view of a fully formed drywall joint according to another embodiment of the invention. This embodiment is similar to that of FIGS. 19-21 except that the separately formed flap SST is secured to the beveled portion of both adjacent beveled edges BE using e.g., a spray on adhesive, before the fasteners F secure the beveled edges BE to the stud WS.

Figure 23:
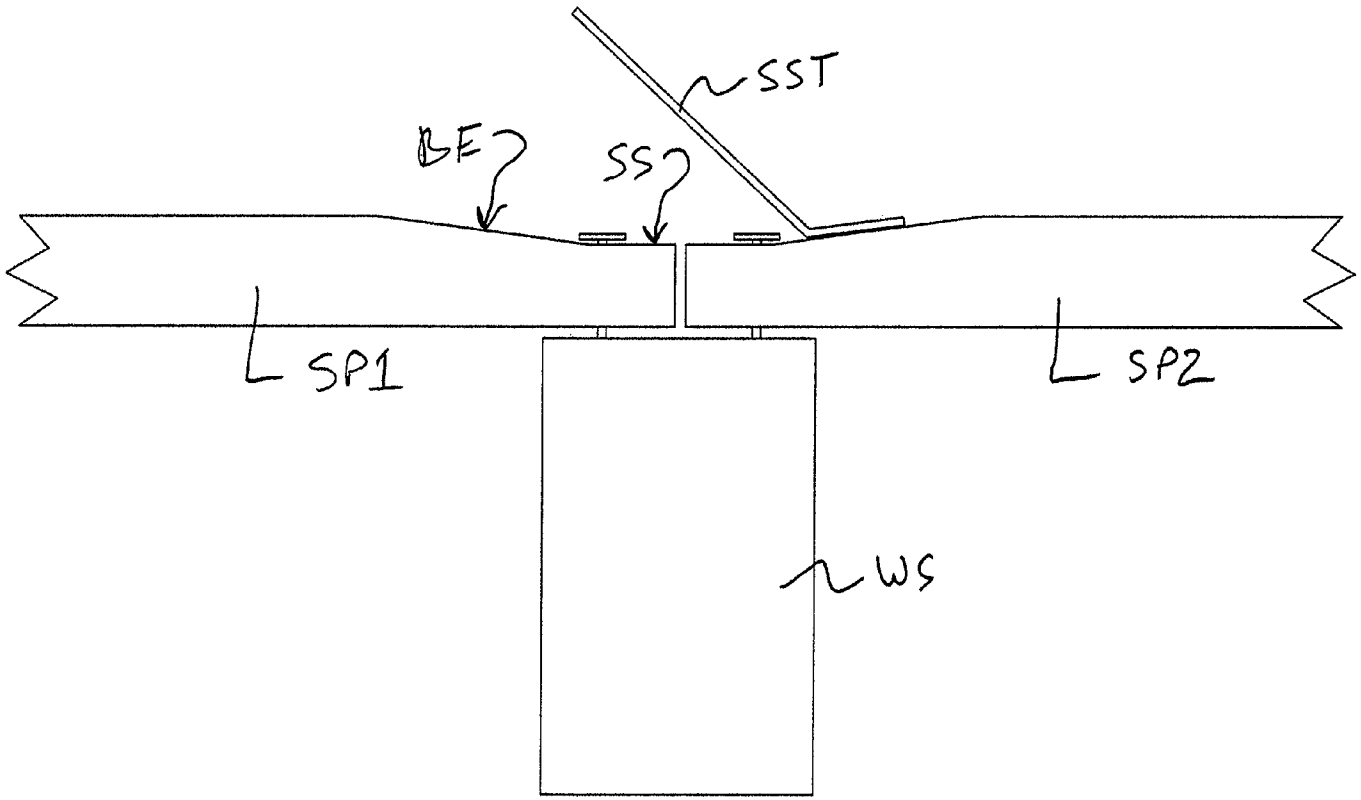
FIG. 23 shows a side view of a partially formed drywall joint according to another embodiment of the invention. This embodiment is similar to that of FIG. 19 except that the beveled edges may have a straight fastening portion which extends from the panel edge to the start of the beveled portion.

FIG. 23 shows a side view of a partially formed drywall joint according to another embodiment of the invention. This embodiment is similar to that of FIG. 19 except that the beveled edges BE have straight fastening portions SS which each extend from the panel edge to the start of the beveled portion.

Figure 24:
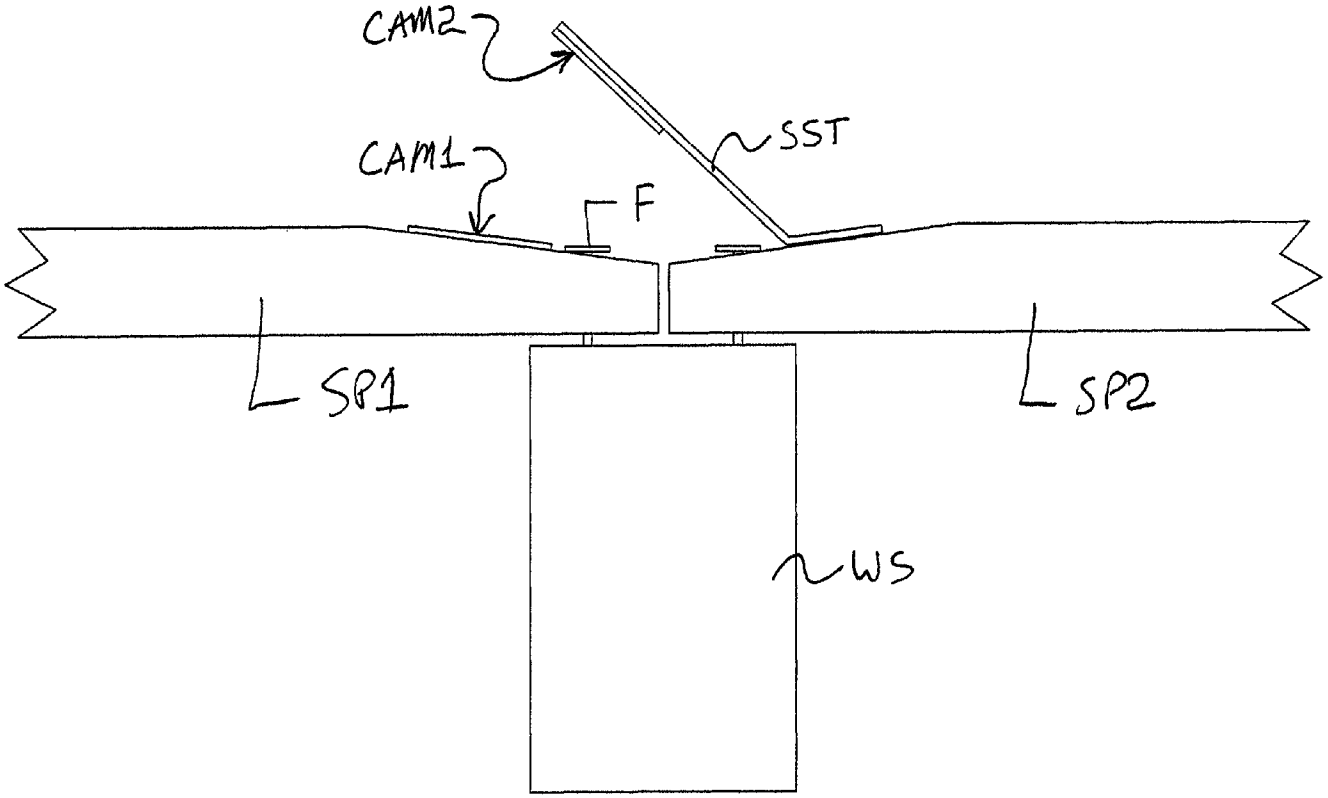
FIG. 24 shows a side view of a partially formed drywall joint according to another embodiment of the invention. This embodiment is similar to that of FIG. 19 except that the separately formed flap may be secured to the beveled portion of one of the beveled edges using contact adhesive layers arranged on both the flap and the beveled portion of an adjacent beveled edge.

FIG. 24 shows a side view of a partially formed drywall joint according to another embodiment of the invention. This embodiment is similar to that of FIG. 19 except that the separately formed flap SST is secured to the beveled portion of the beveled edge BE of panel SP1 using contact adhesive layers CAM1 and CAM2 arranged on both the flap SST and the beveled portion of beveled edge BE of panel SP1. The adhesive layers CAM1 and CAM2 can be conventional layers which function as follows: when the layers CAM1 and CAM2 contact each other they instantly bond to one another. The layers CAM1 and CAM2 can preferably be applied in a factory setting and may or may not utilize peelable covering layers.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A drywall panel comprising in an uninstalled state:

a sheet having a first side, a back side, and oppositely arranged beveled edges arranged on said first side and defining a width of the sheet;

each beveled edge comprising a beveled portion configured to accommodate joint compound material and extending to a sheet side edge;

a flap arranged in an area of one of the beveled edges and having a free end which extends out beyond an end of said one of the beveled edges;

said flap, in an installed state of the drywall panel, being configured to overlie each of:

one of the beveled edges of said sheet; and an abutting beveled edge of another said sheet; and at least one of:

the flap being an integral part of a facing material directly attached to or directly in contact with gypsum arranged in the sheet and forming the first side of the sheet;

the flap being a separately formed member that has one end secured to a facing forming the first side of the sheet and on the beveled portion of said one of the beveled edges wherein the one end secured to the facing has a width that is less than a width of a non-secured portion of the flap; and the flap being a separately formed member that has one end secured to a facing forming the first side of the sheet and adjacent the beveled portion of said one of the beveled edges wherein the one end secured to the facing has a width that is less than a width of a non-secured portion of the flap, wherein the flap has a width that is greater than a width of the beveled portion of said one of the beveled edges and that is less than about twice the width of the beveled portion.

2. The panel of claim 1, wherein the sheet comprises a rectangular shape.

3. The panel of claim 1, wherein the sheet comprises a length of about 8 feet, a width of about 4 feet, and a thickness of between about 0.25 inches and about 0.75 inches.

4. The panel of claim 1, wherein the sheet comprises a length of about 12 feet, a width of about 4 feet, and a thickness of between about 0.25 inches and about 0.75 inches.

5. The panel of claim 1, wherein the flap extends along an entire length of said one of the beveled edges.

6. The panel of claim 1, wherein the sheet has only a single flap.

7. The panel of claim 1, wherein the one end of the flap secured to the beveled portion of said one of the beveled edges has a width that is narrower than the free end.

8. The panel of claim 1, wherein the flap comprises the same material as the facing forming the first side of the sheet.

9. The panel of claim 8, wherein the facing forming the first side of the sheet comprises a paper material.

10. The panel of claim 8, wherein the facing comprises a single layer of material directly attached to or in contact with gypsum arranged within the panel.

11. The panel of claim 1, wherein the one end of the flap is secured by an adhesive to a recessed portion arranged on the first side of the sheet.

12. A drywall joint formed between two panels whose edges abut and do not overlap one another, each of the two panels comprising in an uninstalled state:

a rectangular sheet having a first side, a back side, a gypsum material arranged between the first and second sides, and oppositely arranged beveled edges arranged on said first side and providing tapered joint compound accommodating spaces;

a flap arranged on only one beveled edge of rectangular sheet, the flap having a free end which extends out beyond an end of said only one beveled edge; and at least one of:

the flap being an integral part of a facing material directly attached to or directly in contact with gypsum arranged in the sheet and forming the first side of the sheet; and the flap being a separately formed member that has one end secured to a facing forming the first side of the sheet and on a beveled portion of said only one beveled edge wherein the one end secured to the facing has a width that is less than a width of a non-secured portion of the flap; and the flap being a separately formed member that has one end secured to a facing forming the first side of the sheet and adjacent a beveled portion of said only one beveled edge wherein the one end secured to the facing has a width that is less than a width of a non-secured portion of the flap, wherein the flap has a width that is greater than a width of a beveled portion of said only one beveled edge and that is less than about twice the width of the beveled portion.

13. The joint of claim 12, wherein the flap comprises one of an adhesive substance and a substance which activates an adhesive substance, and wherein the at least one beveled edge comprises one of an adhesive substance and a substance which activates an adhesive substance.

14. The joint of claim 12, wherein the flap comprises the same material as a facing forming the first side of the sheet.

15. The joint of claim 14, wherein the facing forming the first side of the sheet comprises a paper material.

16. The joint of claim 14, wherein the facing comprises a single layer of material directly attached to or in contact with the gypsum arranged within the panel.

17. The joint of claim 12, wherein the flap is a separately formed member that is secured by an adhesive to the first side of the sheet.

18. A drywall panel comprising in an uninstalled state:

a sheet having a first side, a back side, and first and second oppositely arranged comparably configured beveled edges arranged on said first side;

a flap arranged in an area of the second beveled edge and having a free end which extends out beyond an end of said second beveled edge;

the first beveled edge having no flap and forming a tapered joint compound accommodating space; and the flap being a separately formed member that has one end secured to a facing forming the first side of the sheet and one of:

on a beveled portion of said second beveled edge; and adjacent a beveled portion of said second beveled edge, wherein the one end secured to the facing has a width that is less than a width of a non-secured portion of the flap, and wherein the flap has a width that is greater than a width of the beveled portion and less than about twice the width of the beveled portion.

19. A method of forming a drywall joint using two panels of the type recited in claim 18, the method comprising:

arranging the first beveled edge of one sheet adjacent to the second beveled edge of another sheet;

securing the adjacent first and second beveled edges to a stud with fasteners;

covering the fasteners with the flap; and applying a joint compound over at least a portion of the flap.

20. A method of forming a drywall joint using two panels of the type recited in claim 18, the method comprising:

arranging the first beveled edge of one sheet adjacent to the second beveled edge of another sheet;

moving the free end of the flap away from the first beveled edge;

securing the adjacent first and second beveled edges to a stud with fasteners;

covering the fasteners with the flap; and applying a joint compound over at least a portion of the flap.

21. A method of forming a drywall joint using two panels of the type recited in claim 18, the method comprising:

arranging the first beveled edge of one sheet adjacent to the second beveled edge of another sheet;

securing the adjacent first and second beveled edges to a stud with fasteners;

covering the fasteners with the flap; and applying a joint compound over at least a portion of the flap and over at least a portion of the first beveled edge.

22. A method of forming a drywall joint using two panels of the type recited in claim 18, the method comprising:

arranging the first beveled edge of one sheet adjacent to the second beveled edge of another sheet;

securing the adjacent first and second beveled edges to a stud with fasteners;

applying a joint compound over at least a portion of the first and second beveled edges;

covering the fasteners with the flap; and applying a joint compound over at least a portion of the flap and over at least a portion of the first beveled edge.

23. A method of forming a drywall joint using two panels of the type recited in claim 18, the method comprising:

arranging the first beveled edge of one sheet adjacent to the second beveled edge of another sheet;

securing the adjacent first and second beveled edges to a stud;

securing at least a portion of the flap to at least a portion of the first beveled edge; and applying a joint compound over at least a portion of the flap and over at least a portion of the first beveled edge.

24. A method of forming a drywall joint using two panels of the type recited in claim 18, the method comprising:

arranging the first beveled edge of one sheet adjacent to the second beveled edge of another sheet;

securing at least a portion of the flap to at least a portion of the first beveled edge;

securing the adjacent first and second beveled edges to a stud; and applying a joint compound over at least a portion of the flap and over at least a portion of the first beveled edge.

25. A method of forming a drywall joint using two panels of the type recited in claim 18, the method comprising:

arranging the first beveled edge of one sheet adjacent to the second beveled edge of another sheet;

adhesively securing at least a portion of the flap to at least a portion of the first beveled edge;

securing the adjacent first and second beveled edges to a stud with fasteners; and applying a joint compound over at least a portion of the flap.

26. A method of forming a drywall joint using two panels of the type recited in claim 18, the method comprising:

arranging the first beveled edge of one sheet adjacent to the second beveled edge of another sheet;

securing the adjacent first and second beveled edges to a stud with fasteners;

applying a joint compound over at least the fasteners; and applying a joint compound over at least a portion of the flap.

27. A drywall panel comprising in an uninstalled state:

a sheet having a first side, a back side, and oppositely arranged first and second beveled edges defining a width of the sheet and being arranged on said first side;

a flap arranged in an area of the first beveled edge and having a free end which extends out beyond an end of said first beveled edge;

the second beveled edge having no flap and defining a tapered joint compound accommodating space; and the flap being an integral part of a facing material directly attached to or directly in contact with gypsum arranged in the sheet and forming the first side of the sheet, wherein the flap has a width that is greater than a width of a beveled portion of the first beveled edge and less than about twice the width of the beveled portion.

* * * * *